US006405395B1

(12) United States Patent
Poehlmann et al.

(10) Patent No.: US 6,405,395 B1
(45) Date of Patent: Jun. 18, 2002

(54) POCKET TOOL WITH INTERCHANGEABLE COMPONENTS

(75) Inventors: Paul W. Poehlmann, Heriot Bay (CA); Phillip A. Montague, Tualatin, OR (US)

(73) Assignee: Alterra Holdings Corporation, Tigard, OR (US)

( * ) Notice: Subject to any disclaimer, the term of this patent is extended or adjusted under 35 U.S.C. 154(b) by 0 days.

(21) Appl. No.: 09/662,610

(22) Filed: Sep. 14, 2000

Related U.S. Application Data

(63) Continuation of application No. 09/170,992, filed on Oct. 13, 1998, now Pat. No. 6,145,144.

(51) Int. Cl.[7] ..... B25B 7/22
(52) U.S. Cl. ..... 7/128; 7/168; 81/416
(58) Field of Search ..... 7/127–131, 125, 7/167–168; 81/415–416, 419–424, 427.5; 30/156, 192–193, 236, 260, 341–342

(56) References Cited

U.S. PATENT DOCUMENTS

| | | | |
|---|---|---|---|
| 2,055,270 | A | 9/1936 | Villard et al. |
| D113,225 | S | 2/1939 | Heise |
| 2,662,286 | A | 12/1953 | Yeomans |
| 2,940,343 | A | 6/1960 | Hindenburg |
| D257,877 | S | 1/1981 | Patterson |
| D291,769 | S | 9/1987 | Lemcke |
| D317,701 | S | 6/1991 | Grove |
| D320,333 | S | 10/1991 | Grove |
| 5,212,844 | A | 5/1993 | Sessions et al. |
| 5,245,721 | A | 9/1993 | Lowe et al. |
| 5,483,732 | A | 1/1996 | Wang |
| 5,689,886 | A | 11/1997 | Yeh |
| 5,735,005 | A | 4/1998 | Wang |

FOREIGN PATENT DOCUMENTS

| | | | |
|---|---|---|---|
| DE | 296 13 051 | U1 | 10/1996 |

*Primary Examiner*—D. S. Meislin
(74) *Attorney, Agent, or Firm*—Foley & Lardner

(57) ABSTRACT

A multi-function tool includes two channel-shaped handles having a first side wall and a second side wall forming a channel therebetween. An interlocking mechanism includes a first plate extending from the first side wall, and a second plate extending from the second side wall. At least one of the first plates has a periphery with a notch formed therein. At least one of the second side walls has a post extending therefrom. Each handle is releasably engageable by alignment of at least one post of one of the handles with at least one notch of the other handle. The multi-function tool also includes an interchangeable implement including a pair of handles with implement engaging means. An axle assembly extends transversely through the openings formed in the first and second plates and includes a first end member, a second end member, a pair of buttons and a spring. The spring is disposed between each of the buttons to bias the buttons into engagement with the end members. An interchangeable implement is pivotally attached to the axle. The implement has a working portion and an opposed tang portion provided with handle engaging means.

22 Claims, 6 Drawing Sheets

FIG. 1
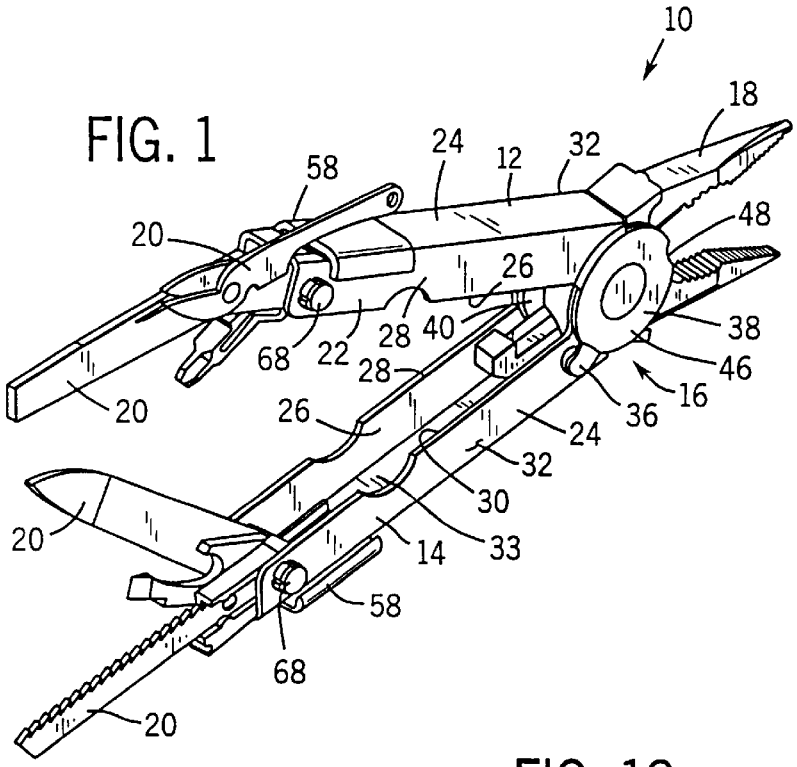
FIG. 12
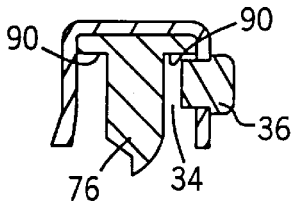
FIG. 10
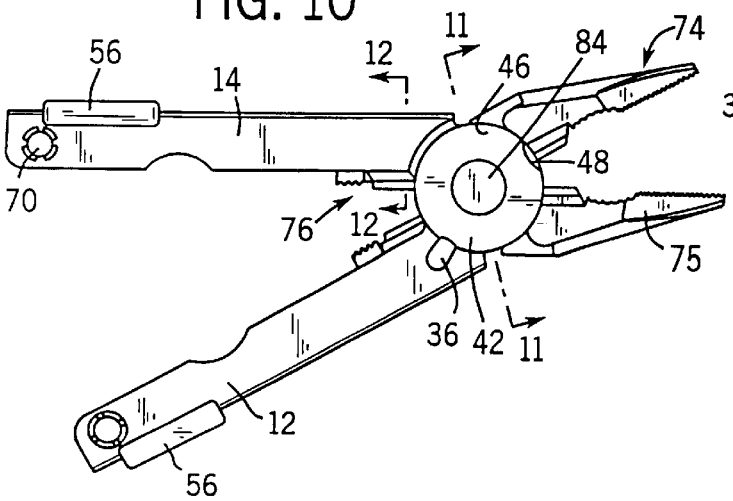
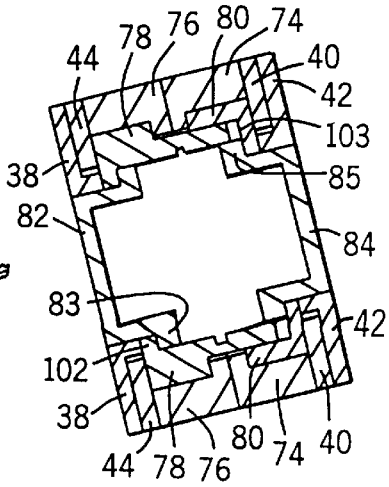
FIG. 11

POCKET TOOL WITH INTERCHANGEABLE COMPONENTS

This application is a continuation of application Ser. No. 09/170,992, now U.S. Pat. No. 6,145,144, filed Oct. 13, 1998.

FIELD OF THE INVENTION

This invention relates to a pocket tool with reversible pliers, and other pivotally attached ancillary tools. More particularly, the present invention relates to a multi-function tool which includes an easily removable implement such as a pair of pliers. The present invention further relates to a pocket tool provided with interchangeable handles.

BACKGROUND OF THE INVENTION

In general, multi-function tools, including in a single instrument, pliers, and other selected tools, such as screwdrivers, knife blades, files and the like, are well known. The prior art multi-function tools typically include a cross-jaw plier with channel-shaped handles connected to the shanks or tangs of the respective plier jaws. In one type of multi-function tool, the cross-jaw pliers are pivotally mounted to the handles at the distal end, the jaws being adapted to nest within the handle for storage. Examples of such multiple tools are described in U.S. Pat. Nos. 4,238,862, 4,744,272 and 4,888,869 issued on Dec. 16, 1980, May 17, 1988 and Dec. 26, 1989, respectively, to Timothy S. Leatherman.

In another type of multi-function tool, the tangs of the respective plier jaws are slidably affixed to the respective handles such that the jaws can be slidably retracted into the interior of the handle channels. Examples of such multi-function tools are described in U.S. Pat. Nos. 5,142,721 and 5,212,844 issued on Sep. 1, 1992 and May 25, 1993, respectively, to Sessions et al. These patents are incorporated herein by reference.

The plier jaws of the multi-function tools identified above are mechanically attached to the handles such that assembly of the plier jaws to the handles or removal of the plier jaws requires the use of a separate tool. The use of a separate tool inhibits the user from easily removing the plier jaws and the mechanical attachment of the jaws to the handles increases manufacturing costs.

It is therefore desirable to provide a multi-function tool in which the tool can be easily attached and removed from the handles without the use of a separate tool. Additionally, it is desirable to provide a handle engagement mechanism on the tool to positively lock the tool into engagement with the handles. Finally, it is also desirable to provide an interlocking mechanism to easily interchange handles, thereby allowing access to a larger variety of tools contained in different handle assemblies.

SUMMARY OF THE PRESENT INVENTION

A multi-function tool in accordance with one aspect of the present invention comprises two channel-shaped handles. Each handle includes a first side wall and a second side wall forming a channel therebetween. The multi-function tool further includes an interlocking mechanism having a first plate extending from the first side wall and a second plate extending from the second side wall. At least one of the first plates has a periphery with a notch formed in one of the first plates. At least one of the second side walls has a post extending from one of the second side walls. Each handle is releasably engageable by the alignment of one of the posts in one of the handles with one of the notches in the other handle.

In accordance with another aspect of the present invention, a multi-function tool comprises a pair of handles. Each handle has a first side wall with a first plate extending therefrom and a second side wall with a second plate extending therefrom. Each of the plates has an opening formed therethrough. The multi-function tool further provides an axle assembly extending transversely through the openings formed in the first and second plates. The axle assembly includes a first end member, a second end member, a pair of buttons and a spring. The spring is disposed between each of the buttons to bias the buttons into engagement with the end members. The multi-function tool further includes a removable implement pivotally attached to the axle. The implement has a working portion and an opposed tang portion provided with a detent. The detent matingly engages a post extending from the second side wall into a channel formed between the first side wall and the second side wall.

Yet another aspect of the present invention is a multi-function tool having a pair of handles including implement engaging means. Each handle has a first side wall with a first plate extending therefrom and a second side wall with a second plate extending therefrom. An opening is formed through each of the plates. The multi-function tool further includes an axle assembly extending transversely through the openings formed in the first and second plates. The axle assembly includes a first end member, a second end member, a pair of buttons and a spring. The spring is disposed between each of the buttons to bias the buttons into engagement with the end members. The multi-function tool further provides an interchangeable implement pivotally attached to the axle. The implement has a working portion and an opposed tang portion. The tang portion is provided with handle engaging means.

Other principal features and advantages of the invention will become apparent to those skilled in the art upon review of the following drawings, the detailed description and the appended claims.

BRIEF DESCRIPTION OF THE DRAWINGS

The invention will hereafter be described with reference to the accompanying drawings, wherein like reference numerals denote like elements, and:

FIG. 1 is an isometric view of the pocket tool of the present invention in an open position with interchangeable handles;

FIG. 10 is a side view of the pocket tool of the present invention in an open position with interchangeable handles and removable implements;

FIG. 11 is a cross-sectional view taken generally along line 11—11 of FIG. 10;

FIG. 12 is a cross-sectional view taken generally along line 12—12 of FIG. 10;

DETAILED DESCRIPTION OF A PREFERRED EXEMPLARY EMBODIMENT

Figure 2:
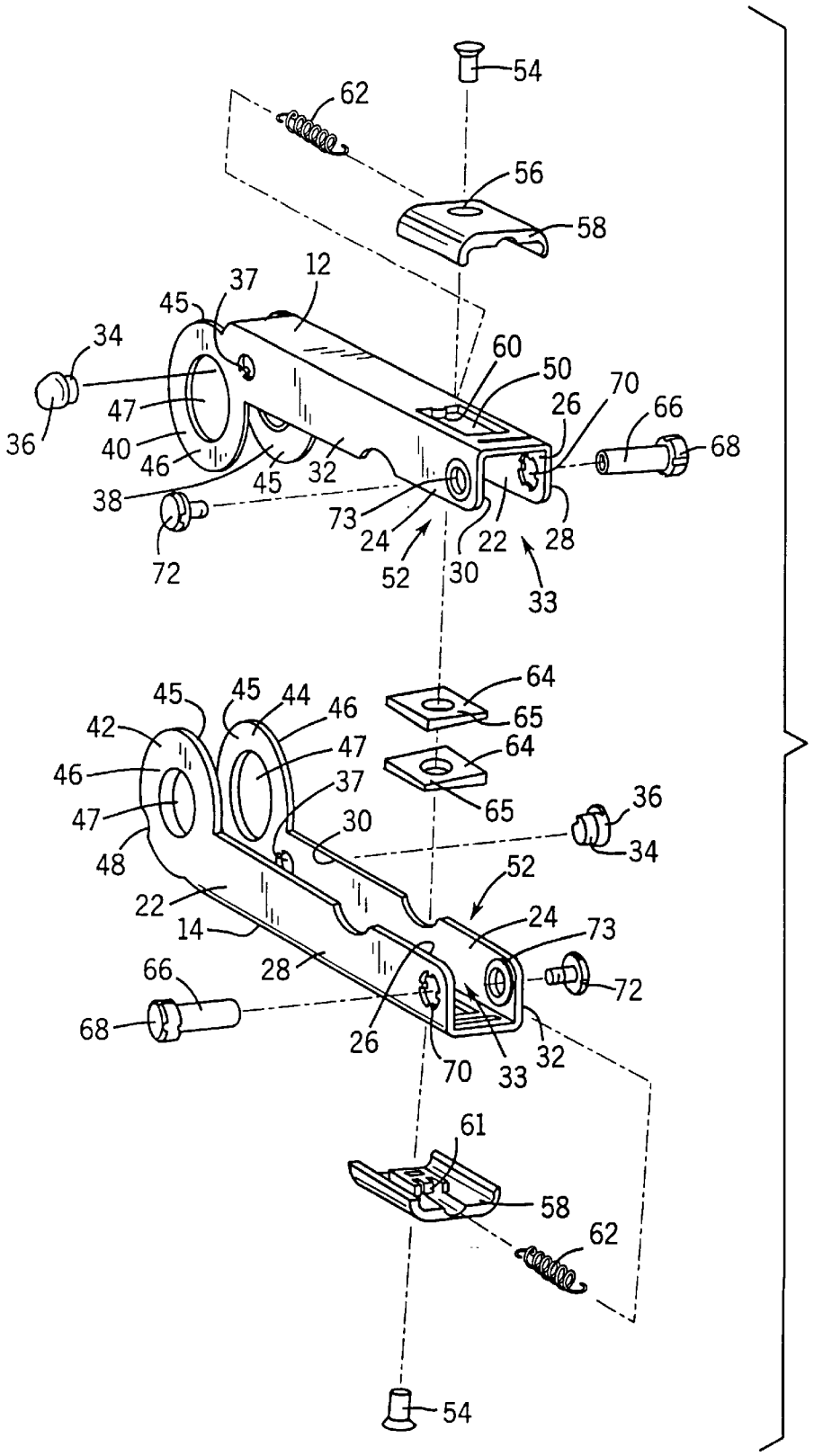
FIG. 2 is an exploded view of the interchangeable handles of the present invention.

Referring to FIG. 1, a detailed description of an exemplary multi-function tool 10 in accordance with the present invention will be described. Tool 10 includes a first channel-shaped handle 12, a second channel-shaped handle 14, an axle assembly 16, an interchangeable implement 18, and a plurality of pivotally attached ancillary tools 20.

First handle 12 includes a first side wall 22 and second handle 14 includes a second side wall 24, wherein first side wall 22 includes an inner surface 26 and an outer surface 28, and second side wall 24 includes an inner surface 30 and an outer surface 32. Inner surfaces 26 and 30 further define a channel 33 traversing the length of handles 12 and 14 and providing storage space for interchangeable implement 18 and ancillary tools 20. As will be explained in greater detail below, interchangeable implement 18 is removably and pivotally attached to axle assembly 16. Additionally, in the preferred embodiment of the present invention, handles 12 and 14 are each releasably engageable with axle assembly 16.

Referring to FIG. 2, the structure of handles 12 and 14 with regard to interchangeability will be described in greater detail. An inwardly extending post 34 coupled to an outwardly extending post 36 is received in an aperture 37 formed in second side walls 24 of handles 12 and 14. Inwardly extending post 34 extends perpendicular to inner surface 30 of second side wall 24 through channel 33 towards inner surface 26 of first side wall 22. Outwardly extending post 36 extends perpendicular to outer surface 32 of second side wall 24.

First handle 12 further includes a first plate 38 extending from first side wall 22 and a second plate 40 extending from second side wall 24. Similarly, second handle 14 further includes a first plate 42 extending from first side wall 22 and a second plate 44 extending from second wall 24. In the preferred embodiment, plates 38, 40, 42 and 44 are substantially circular with an inner surface 45 adjacent to inner surfaces 26 and 30, and an outer surface 46 adjacent to outer surfaces 28 and 32. An opening 47 formed through the center region of plates 38, 40, 42 and 44 is configured to receive axle assembly 16. A notch 48 is formed in the periphery of first plates 38 and 42, wherein each handle is releasably engageable by alignment of outwardly extending post 36 with notch 48.

Figure 3:
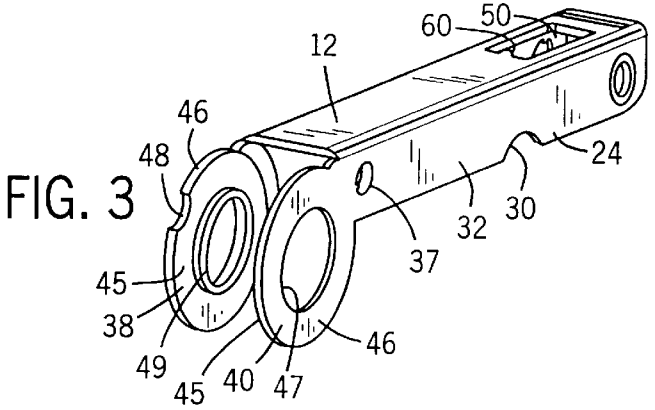
FIG. 3 is an isometric view of one of the interchangeable handles of FIG. 2.
Figure 4:
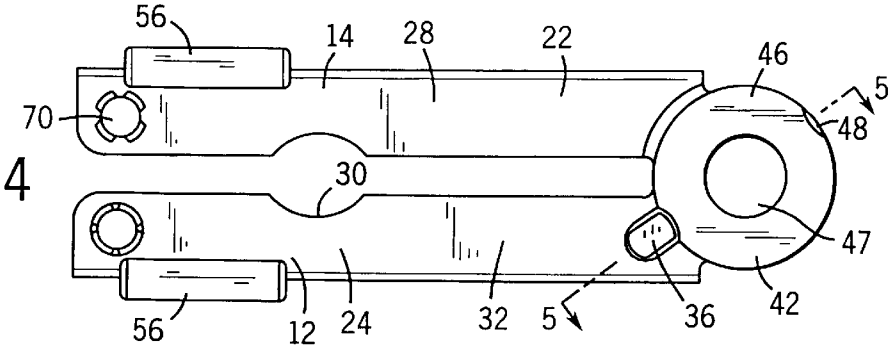
FIG. 4 is a partial side view of the interchangeable handles of the present invention in a closed position.

Additionally, first plates 38 and 42 include a shoulder 49 (See FIG. 3) formed along the periphery of opening 47 and extending perpendicular to inner surface 45. In the preferred embodiment, outer surfaces 46 of first plates 38 and 42 are offset from outer surfaces 28 of first side walls 22 by a thickness equal to first side wall 22. On the other hand, outside surfaces 46 of second plates 40 and 44 are substantially flush with outer surfaces 32 of second side walls 24. This placement of plates 38, 40, 42 and 44. results in opening 47 of second plate 40 of first handle 12 rotationally engaging shoulder 49 formed on inner surface 45 of first plate 42 of second handle 14, while opening 47 of second plate 44 of second handle 14 engages shoulder 49 formed on inner surface 45 of first plate 38 of first handle 12.

First and second handles 12 and 14 also include a locking mechanism wherein a generally rectangular opening 50 extends through handles 12 and 14 located proximate a distal end 52 opposite plates 38, 40, 42 and 44. A rivet 54 extends through an aperture 56 in a locking button 58. A spring post 60 extends into rectangular opening 50 by a predetermined distance toward distal end 52. Locking button 58 includes a spring post 61 configured to receive one end of a compression spring 62. The other end of compression spring 62 is received by spring post 60. Rivet 54 secures locking button 58 to a wedge 64 having a beveled region 65. An axle bolt 66 having a keyed head 68 is received within a keyed aperture 70 located through first side wall 22 proximate distal end 52 of handles 12 and 14. Axle bolt 66 is secured by a screw 72 threaded through an aperture 73 formed in second side wall 24.

Figure 5:
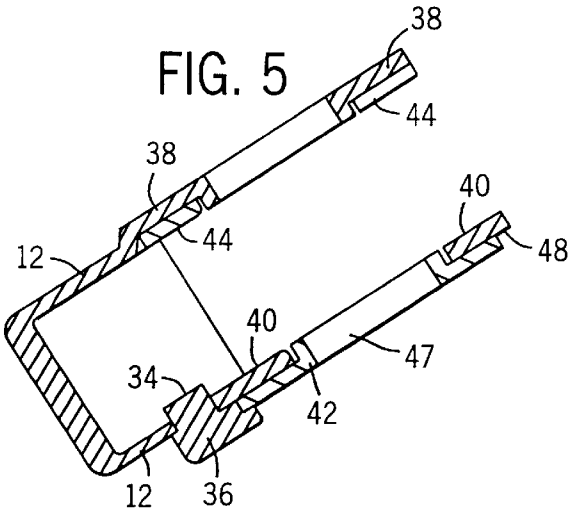
FIG. 5 is a cross-sectional view taken generally along line 5—5 of FIG. 4.

Releasable engagement of handles 12 and 14 is accomplished by the interlocking of plates 38, 40, 42 and 44 in addition to the engagement of post 36 with notch 48. In particular, as shown in. FIGS. 3–6, post 36 overlaps outer surface 46 of plates 38 and 42 unless handles 12 and 14 are at a 180° angle to one another (FIG. 5). When handles 12 and 14 are at a 180° angle to one another (FIG. 6), post 36 is received in notch 48, resulting in outer surfaces 46 of plates 38 and 42 not being retained in mating engagement with one another. However, it is possible to set the relative angle to a position other than 180 degrees depending upon the specific location of the notch 48 and post 36. At any other angle other than 180°, post 36 overlaps outer surfaces 46 of plates 38 and 42, thereby retaining plates 38, 40, 42 and 44 in locked engagement. Handle 12 or 14 is removed by placing the handles in the position illustrated by FIG. 6 and pulling one of the handles away from the other handle after post 36 is received in notch 48. A new handle then is inserted by aligning the post or notch of the new handle with the respective post or notch of the old handle.

Figure 8:
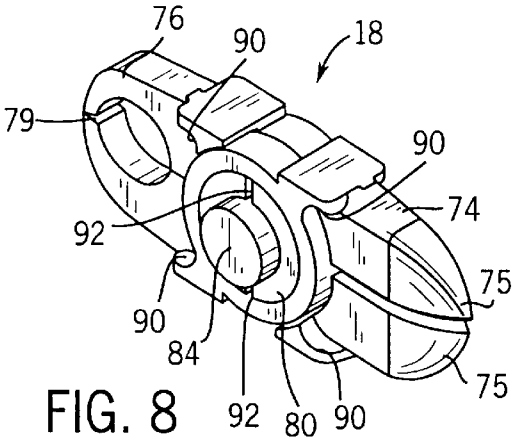
FIG. 8 is an isometric view of the two separate implements of FIG. 7.
Figure 7:
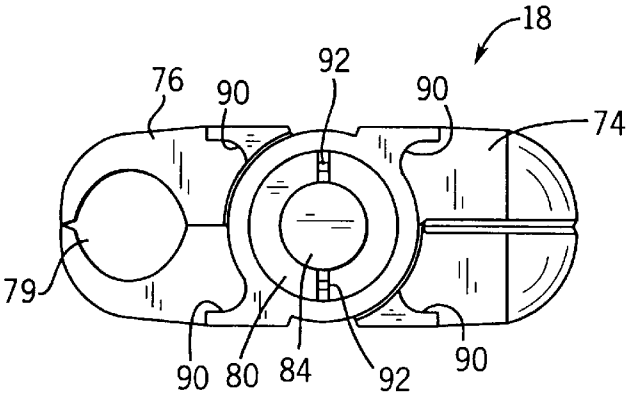
FIG. 7 is a side view of reversible implements of the present invention which are removable from the pocket tool of FIG. 1.
Figure 9:
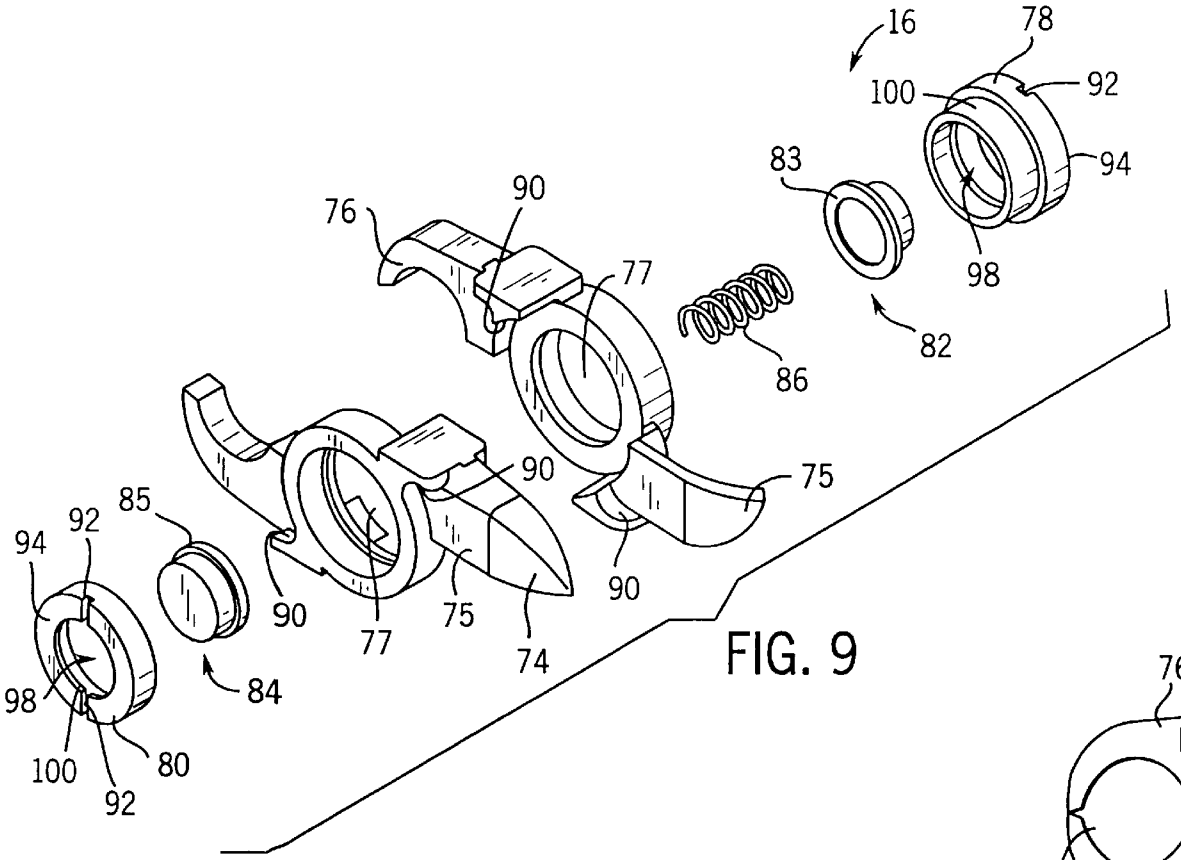
FIG. 9 is an exploded view of the axle assembly and implements of FIGS. 7 and 8.
Figure 13:
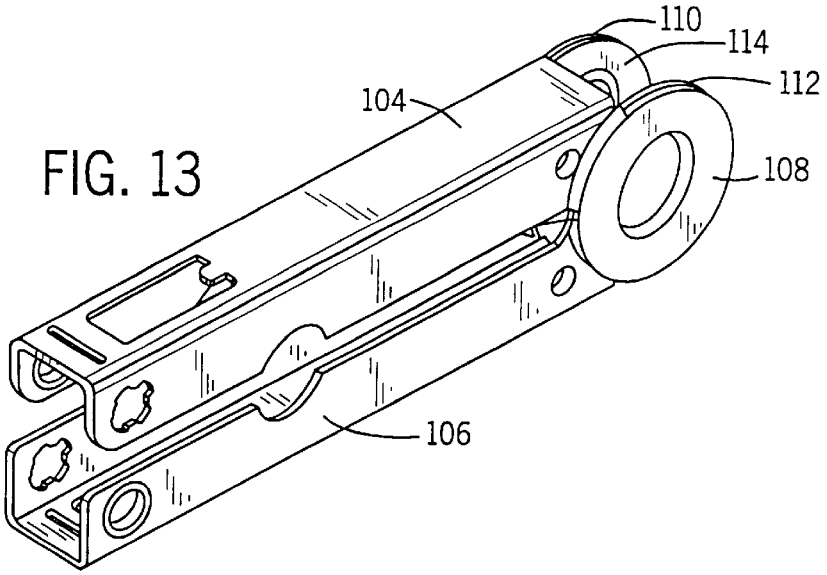
FIG. 13 is an isometric view of a pair of noninterchangeable handles of an alternate embodiment of the present invention.
Figure 14:
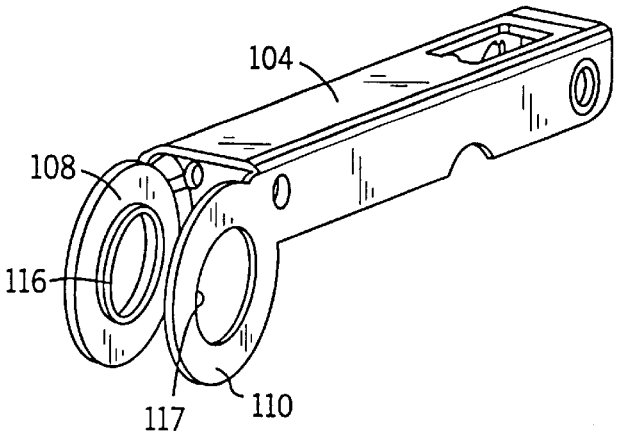
FIG. 14 is an isometric view of one of the noninterchangeable handles of FIG. 13.
Figure 15:
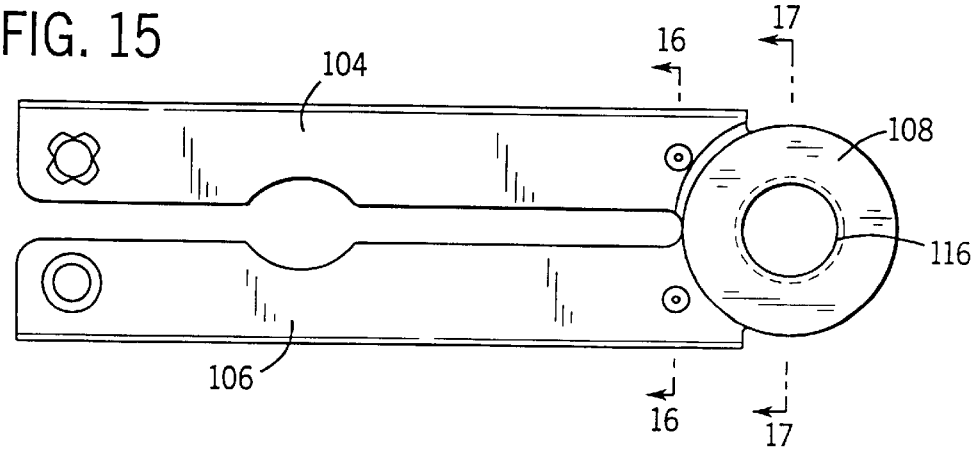
FIG. 15 is a side view of the pair of noninterchangeable handles of FIG. 13.
Figure 16:
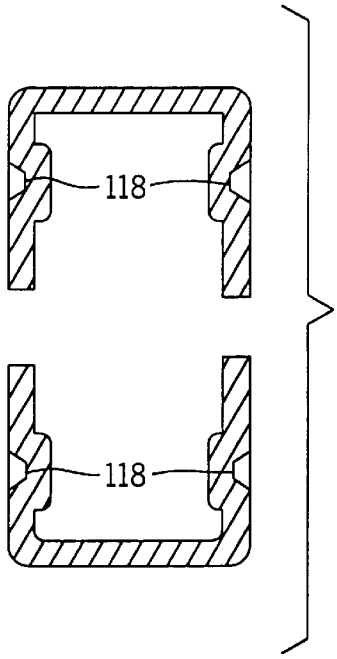
FIG. 16 is a cross-sectional view taken generally along line 16—16 of FIG. 15.
Figure 17:
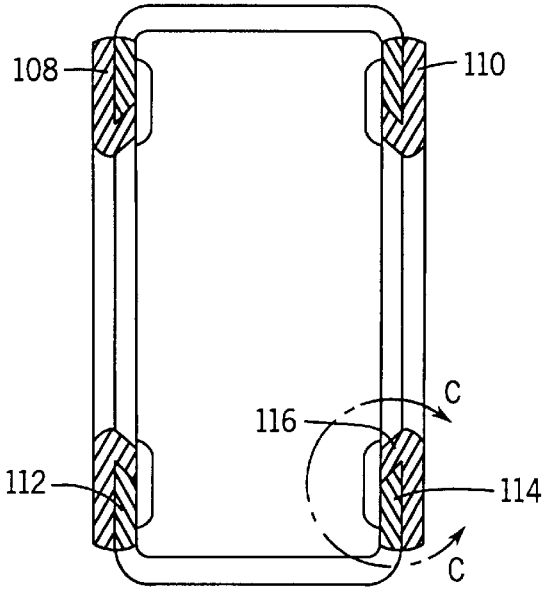
FIG. 17 is a cross-sectional view taken generally along line 17—17 of FIG. 15.
Figure 18:
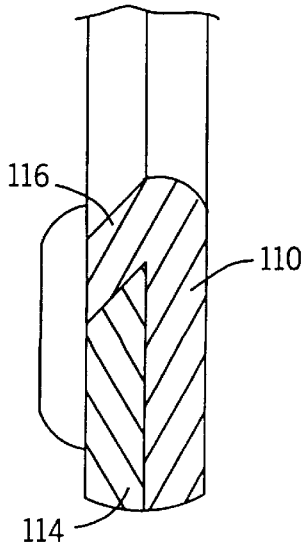
FIG. 18 is an enlarged view of detail C of FIG. 17.

Referring to. FIGS. 7–9, axle assembly 16 permits implement 18 to be easily interchanged with other implement assemblies. In the preferred embodiment, a working portion 74 of implement 18 is positioned opposite distal end 52 of handles 12 and 14. Working portion 74 may be a wire cutter having a set of interlocking jaws 75. A tang portion 76 is located opposite working portion 74 and received in channel 33 of handles 12 and 14. In the preferred embodiment, tang portion 76 is also a working implement such as a nipper 79.

As illustrated in FIGS. 9 and 11, axle assembly 16 extends transversely through openings 47 formed in plates 38, 40, 42 and 44, and a central opening 77 formed in implement 18 between working portion 74 and tang portion 76. Axle assembly 16 includes a first end member 78, a second end member 80, a first button 82, a second button 84, and a spring 86. First end member 78 and second end member 80 include an inwardly extending flange 102, 103 respectively. Each button 82, 84 includes an outwardly extending flange 83, 85 respectively. Spring 86 is disposed between each button 82 and 84 to bias buttons 82 and 84 into engagement with end members 78 and 80, such that flanges 83, 85 of buttons 82, 84 are in contact with flanges 102, 103 of end members 78, 80 respectively (See FIG. 11). A detent 90 formed between central opening 77 and tang portion 76 engages inwardly extending posts 34. Implement 18 is restricted from movement by the abutment of detent 90 with posts 34.

A service tool can be inserted in a groove 92 formed in atop surface 94 of first and second end members 78 and 80 to unlock axle assembly 16. Buttons 82 and 84 are inserted through a button opening 98 formed in the center of end members 78 and 80. A cylindrical portion 100 of first member 78 threadingly engages cylindrical portion 100 of second member 80. In the alternative, member 78 can be press fit with member 80. FIGS. 10, 11 and 12 further illustrate the preferred embodiment of the present invention having removable jaws 75 and interchangeable handles 12 and 14.

FIGS. 13–18 illustrate an alternative embodiment of the present invention wherein multi-function tool 10 includes a first unremovable handle 104 and a second unremovable handle 106. First handle 104 includes a first plate 108 and a second plate 110 extending therefrom, and second handle 106 includes a first plate 112 and a second plate 114 extending therefrom. A shoulder 116 engages a beveled edge formed in an opening 117 in second plate 114 wherein the edges of shoulder 116 are permanently crimped over beveled edges along opening 117 to secure plates 108, 110, 112 and 114 together. Handles 104 and 106 further include a plurality of inwardly projecting posts 118 configured to engage detent 90 formed in interchangeable implement 18.

Figure 6:
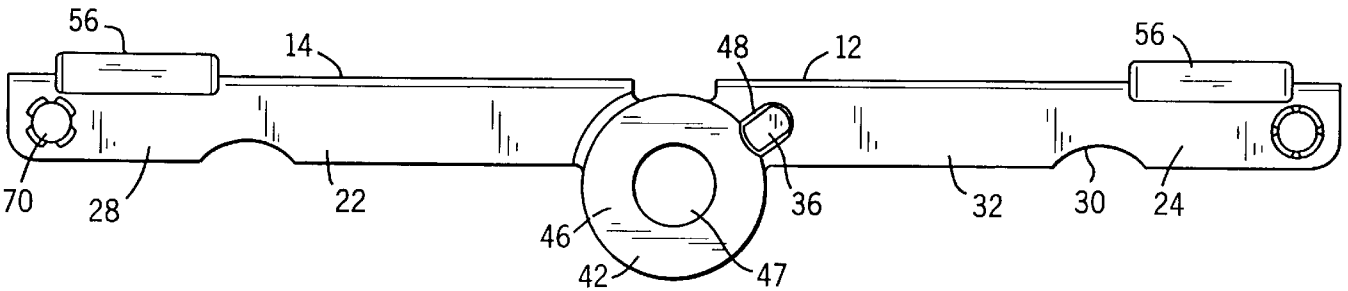
FIG. 6 is a partial side view of the interchangeable handles of the present invention with one handle at a 180° angle to the other handle.

The operation of reversing and/or interchangeable implement 18 and interchanging handles 12 and 14 will now be explained in reference to FIGS. 10 and 6. As shown in FIG. 10, working portion 74 is in the extended working position. A user can remove implement 18 to employ working portion 76 by depressing buttons 82 and 84 towards one another until the top surface of buttons 82 and 84 no longer engage any of plates 38, 40, 42 and 44. Implement 18 is then simply pulled straight out away from handles 12 and 14. To employ working portion 76, implement 18 is simply flipped over and working portion 74 is inserted into channel 33. Buttons 82 and 84 are depressed until engagement with plates 38, 40, 42 and 44 is achieved. As implement 18 is inserted into channel 33 detents 90 engage posts 34 so that the handles operate to pivot the working implement 76 about axle assembly 16.

Additionally, either handle 12 or 14 can be interchanged with a different handle by initially positioning handle 12 with respect to handle 14 so that notch 48 aligns with post 36. Once notch 48 is in alignment with post 36, either handle 12 or 14 can be removed by pulling one of the handles in a direction away from the other handle. A new handle can be inserted by aligning the notch and post of the new handle with the notch and the post of the existing handle. After the notches and posts of the new handle are aligned with the notches and posts of the existing handle, locking engagement of plates 38, 40, 42 and 44 is achieved by rotating one or both of the handles away from the positions of alignment between notch 48 and post 36.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A multi-function tool, the tool comprising:

a pair of handles, each handle having a first side wall with a first plate extending therefrom and a second side wall with a second plate extending therefrom, each of the plates having an opening therethrough;

a post secured to at least one of the side walls of each handle;

an axle assembly extending transversely through the openings formed in the first and second plates; and a removable implement pivotally coupled to the axle assembly, the implement having a working portion and an opposed portion;

wherein the posts engage the opposed portion.

2. The multi-function tool of claim 1, wherein the removable implement is comprised of a pair of jaws, each jaw having a working portion and an opposed tang portion;

wherein the posts engage the tang portions.

3. The multi-function tool of claim 2, wherein each tang portion has a detent;

wherein each detent engages one of the posts.

4. The multi-function tool of claim 1, further comprising:

a detent formed in the removable implement;

wherein the detent releasably engages one of the posts.

5. The multi-function tool of claim 1, wherein the posts interlock with the opposed portion, whereby the working portion opens when the handles are spread apart, and the working portion closes when the handles are brought together.

6. The multi-function tool of claim 1, wherein the posts each have a free end disposed between the first and second side walls.

7. The multi-function tool of claim 1 wherein the removable implement is reversible such that the opposed portion becomes the working portion.

8. The multi-function tool of claim 1 further comprising:

a shaft mounted between the first and second side walls distal the axle of at least one of the handles; and a plurality of tool implements pivotally mounted on the shaft.

9. The multi-function tool of claim 1 wherein the axle assembly has a first end member, a second end member, a pair of buttons and a spring, the spring disposed between each of the buttons to bias the buttons into engagement with the end members.

10. A tool, comprising:

a pair of handles, each handle having a first end and a second end;

an axle pivotally connecting the handles at the first end; and a removable implement, reversibly secured to the axle;

wherein the axle has a first end member, a second end member, a pair of buttons and a spring, the spring disposed between each of the buttons to bias the buttons into engagement with the end members.

11. A tool, comprising:

a pair of handles, each handle having a first end and a second end;

an axle pivotally connecting the handles at the first end;

a removable implement, reversibly secured to the axle; and a post extending from each of the handles;

wherein the posts engage the removable implement.

12. The multi-function tool of claim 11, further comprising:

a detent formed in the removable implement; wherein the detent releasably engages one of the posts.

13. The multi-function tool of claim 11, wherein the posts interlock with the removable implement, whereby the working portion opens when the handles are spread apart, and the working portion closes when the handles are brought together.

14. The multi-function tool of claim 11, wherein the posts each have a free end disposed within each of the handles.

15. A multi-function tool, the tool comprising:

a pair of handles, each handle having a first side wall with a first plate extending therefrom and a second side wall with a second plate extending therefrom, each of the plates having an opening therethrough;

each handle having a post extending therefrom;

an axle assembly extending transversely through the openings formed in the first and second plates; and an implement releasably coupled to the axle assembly, the implement having a working portion and an opposed portion, wherein the posts engage the opposed portion;

a shaft mounted between the first and second side walls distal the axle of at least one of the handles; and a plurality of tools pivotally mounted on the shaft.

16. The multi-function tool of claim 15, wherein the implement is comprised of a pair of jaws, each jaw having a working portion and an opposed tang portion;

wherein the tang portions are engaged by the posts.

17. The multi-function tool of claim 16, wherein each tang portion has a detent;

wherein each detent engages one of the posts.

18. The multi-function tool of claim 15 wherein the implement is reversible such that the opposed portion becomes the working portion.

19. The multi-function tool of claim 15 wherein the axle assembly has a first end member, a second end member, a pair of buttons and a spring, the spring disposed between each of the buttons to bias the buttons into engagement with the end members.

20. The multi-function tool of claim 15, further comprising:

a detent formed in the implement;

wherein the detent releasably engages one of the posts.

21. The multi-function tool of claim 15, wherein the posts interlock with the opposed portion, whereby the working portion opens when the handles are spread apart, and the working portion closes when the handles are brought together.

22. The multi-function tool of claim 15, wherein the posts each have a free end disposed between the first and second side wall.

* * * * *